US007204480B1

(12) United States Patent
Simmons

(10) Patent No.: US 7,204,480 B1
(45) Date of Patent: Apr. 17, 2007

(54) PRYING TOOL FOR DISLODGING CONCRETE FORMS FROM POURED CONCRETE WALLS

(76) Inventor: Mark Simmons, 6 Chestnut St., Rehoboth, MA (US) 02769

( * ) Notice: Subject to any disclaimer, the term of this patent is extended or adjusted under 35 U.S.C. 154(b) by 0 days.

(21) Appl. No.: 11/471,150

(22) Filed: Jun. 20, 2006

(51) Int. Cl.
*B66F 15/00* (2006.01)

(52) U.S. Cl. ..... 269/25

(58) Field of Classification Search ..... 254/25, 254/131, 20, 18, 131.5
See application file for complete search history.

(56) References Cited

U.S. PATENT DOCUMENTS 2,087,148 A * 7/1937 Hempy ..... 254/25
2,382,831 A * 8/1945 Tabellione ..... 254/25
6,988,711 B2 * 1/2006 Skach ..... 254/25
7,025,331 B2 * 4/2006 Whelan ..... 254/25
7,039,993 B1 * 5/2006 Smith et al. ..... 29/235

* cited by examiner

*Primary Examiner*—Lee D. Wilson

(57) ABSTRACT

The pry tool of the present invention is utilized for dislodging concrete forms from set concrete. It includes a fulcrum assembly and pivoting leveraging member in operative juxtaposition to the fulcrum assembly. One end of the fulcrum assembly engages a first single concrete form member connecting slot and the opposite end of the fulcrum assembly connects to a pivoting leveraging member. The leveraging member is parallel and set off from the fulcrum assembly in direct alignment with a second adjacent concrete form. The leveraging member is hand manipulated to exert force against the second adjacent concrete form forcing the form inward into the concrete wall. This causes a leveraging action with the engaged end of the fulcrum assembly forcing the first concrete form outward away from the concrete wall and thereby separating the form from the wall.

13 Claims, 7 Drawing Sheets

PRYING TOOL FOR DISLODGING CONCRETE FORMS FROM POURED CONCRETE WALLS

BACKGROUND OF THE INVENTION

1. Field of the Invention

This invention concerns pry tools and more particularly pry tools especially adapted for dislodging concrete forms from set concrete.

2. Description of the Prior Art

Concrete shapes, such as walls and the like, are often poured on the job site with the aid of forms made of steel or the like. The forms are constructed by placing the form walls side by side, passing tie rods between the form walls, and exerting a pulling force on each tie rod to draw the forms towards one another. The tie rods are inserted through a series of parallel connecting slots that are punched through the form walls. A plurality of parallel rows of forms in end to end alignment are provided to make up a complete concrete form.

After pouring of the concrete, the forms must be dislodged from the set concrete, which task has not heretofore been able to be easily carried out without encountering considerable difficulties.

Firstly, the workers are obliged to work overhead which requires a very taxing physical effort.

Secondly, the dislodging process has been relatively slow and time-consuming since there has heretofore been no highly effective manner of engaging the forms with a pry tool. Generally, simple pry bars or crowbars have been used to pry loose the forms. However, the lip edges of the forms are not overly large to allow effective engagement of a pry bar and pry bars often cause damage to the finished concrete walls.

The resulting difficulties encountered by the construction workers renders this particular task rather labor intensive and time consuming. Also, the nature of the construction process relating to this particular stage of construction is such that it is very common for large numbers of workers to be waiting for removal of such concrete forms, this task thus representing a bottle-neck operation in the overall process.

It would be highly advantageous if this process could be carried out in a more expeditious manner since the related labor costs could be greatly reduced in those instances where large numbers of construction workers are forced to wait for the completion of this task. Also, it would be much to the advantage of the workers actually engaged in the activity since the effort involved using the tool of the present invention would reduce direct labor costs since the dislodging process would be expedited.

SUMMARY OF THE INVENTION

It is an object of this invention to separate forming systems from the hardened and set concrete with a minimum of damage to the concrete or chipping of the concrete.

It is another object of this invention to accomplish the foregoing in a faster and easier manner than can be accomplished without using the prying tool of this invention.

It is another object of this invention to separate forming systems from set concrete with reduced physical force, and to reduce injuries such as wrenching one's back in straining to remove the form from the set concrete.

It is another object of this invention to accomplish the foregoing by the use of the prying tool of this invention which can be easily and inexpensively manufactured.

Broader aspects of the invention and devices within the scope of the same will become clearer from a further reading of the specification and claims and a consideration of the drawings. These and other objects which will become apparent upon a reading of the following Specification and Claims in which a pry tool is disclosed for separating adjacent framed concrete forms.

The pry tool of the present invention comprises a fulcrum assembly and pivoting leveraging member in operative juxtaposition to the fulcrum assembly. One end of the fulcrum assembly engages a first single concrete form member connecting slot and the opposite end of the fulcrum assembly connects to a pivoting leveraging member. The leveraging member is parallel and set off from the fulcrum assembly in direct alignment with a second adjacent concrete form. The leveraging member is hand manipulated to exert force against the second adjacent concrete form forcing the form inward into the concrete wall. This causes a leveraging action with the engaged end of the fulcrum assembly forcing the first concrete form outward away from the concrete wall and thereby separating the form from the wall.

BRIEF DESCRIPTION OF THE DRAWINGS

The invention is best understood from the following detailed description when read in connection with the accompanying drawings, which illustrate an embodiment of the present invention.

DETAILED DESCRIPTION OF THE INVENTION

It should be understood that the following is a detailed description of the invention and that numerous changes to the disclosed embodiments can be made in accordance with the disclosure herein without departing from the spirit or scope of the invention. Rather, the scope of the invention is to be determined only by the appended claims and their equivalents.

Referring to FIGS. 1–4, a prying tool is disclosed comprising a fulcrum assembly 5, a pivoting leveraging member 10, and a handle member 15. Fulcrum assembly 5 includes a first side surface 5C and a second side surface 5D. First side surface 5C includes at one end a protuberance 5A and at the opposite end an extension section 5B extending outward at a right angle from the opposite end. Leveraging member 10 includes at one end a pivoting engagement means 10A and at the opposite end a handle extending outward therefrom. Handle member 15 is connected to leveraging member 10 through a socket type connection 15A.

Handle member 15 may also be rigidly connected to leveraging member 10 or utilize a socket connection that allows handle member 15 to have different angular extensions. This is accomplished utilizing a locking mechanism embodied within socket connection 15A that can lock handle member 15 at different angles. The pivoting engagement means 10A includes an attachment mechanism that secures the opposite end extension section 5B of the fulcrum assembly 5 to the leveraging member 10 at one end in a manner that allows the leveraging member 10 to loosely rotate about the axis of the pivoting engagement means 10A.

Figure 1:
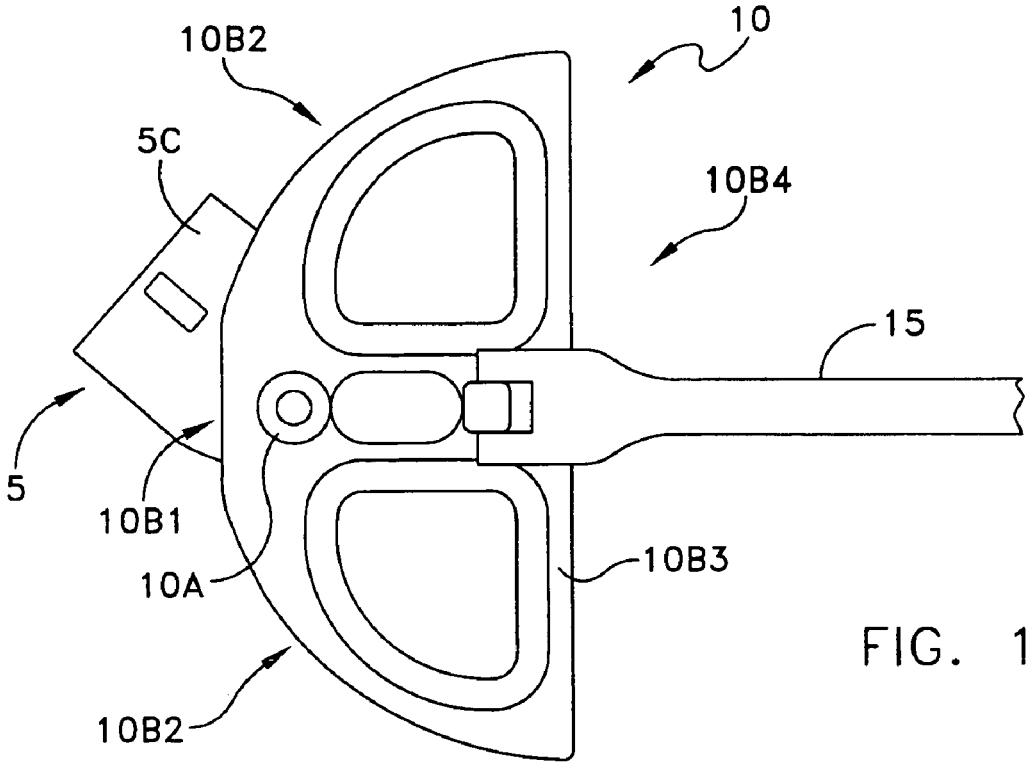
FIG. 1 illustrates a left side view of the preferred embodiment of the prying tool of subject invention.
Figure 2:
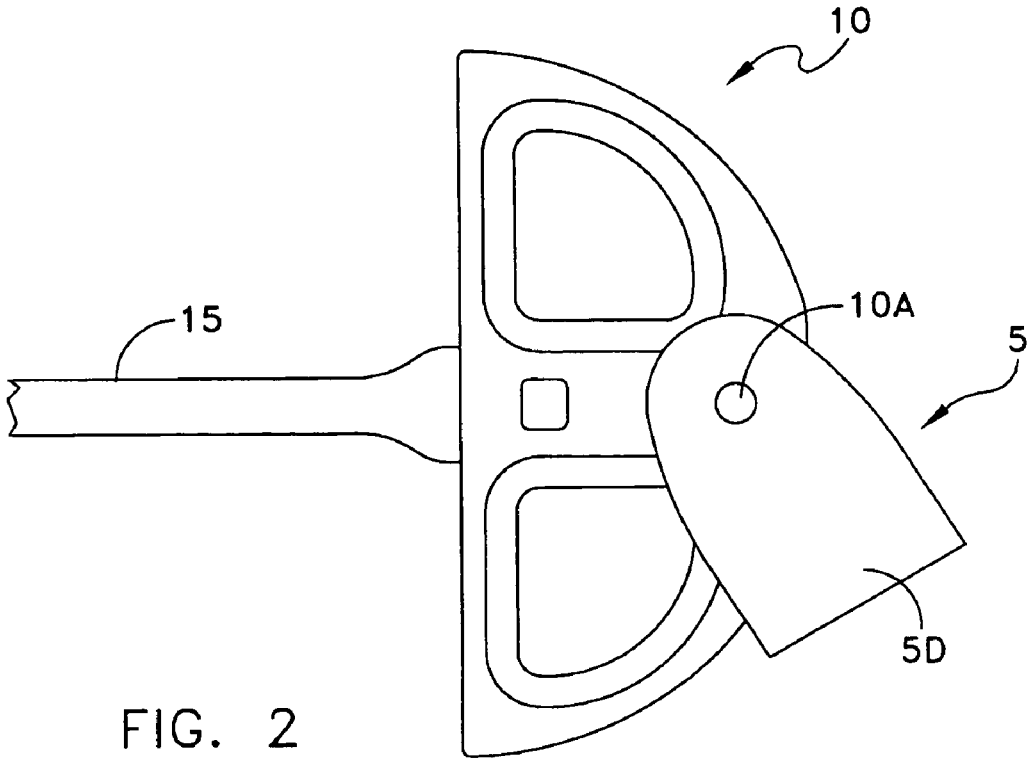
FIG. 2 illustrates a right side view of the invention of FIG. 1.
Figure 3:
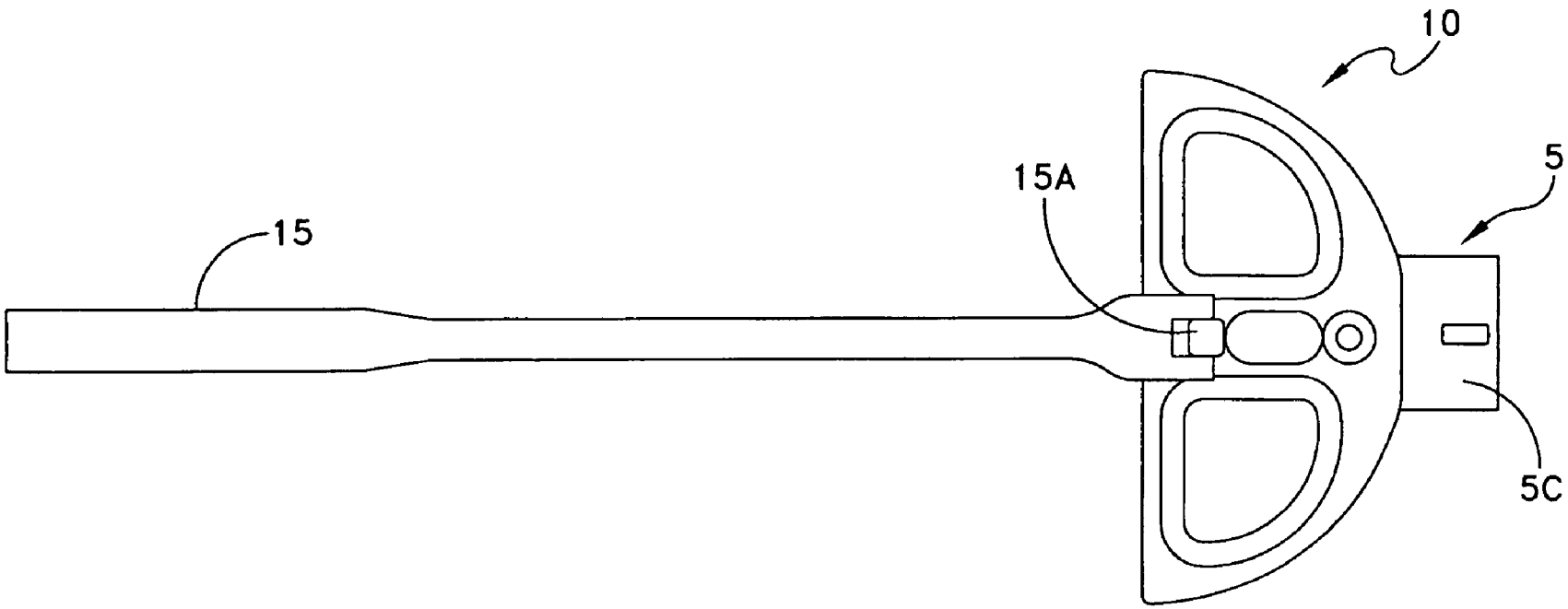
FIG. 3 illustrates the invention of FIG. 1 showing a pivoted fulcrum assembly 5.

In the preferred embodiment the attachment mechanism is a solid bar extending through the fulcrum assembly and leveraging member, creating a fulcrum point. Referring to FIG. 1, leveraging member 10 includes an engagement surface 10B1 and 10B2 and first and second side surfaces 10B3 and 10B4. In the preferred embodiment, surface 10B1 is flat to allow for mating up against a frame member and surface 10B2 is semi-circular and manipulated to exert force against a frame member.

Figure 8:
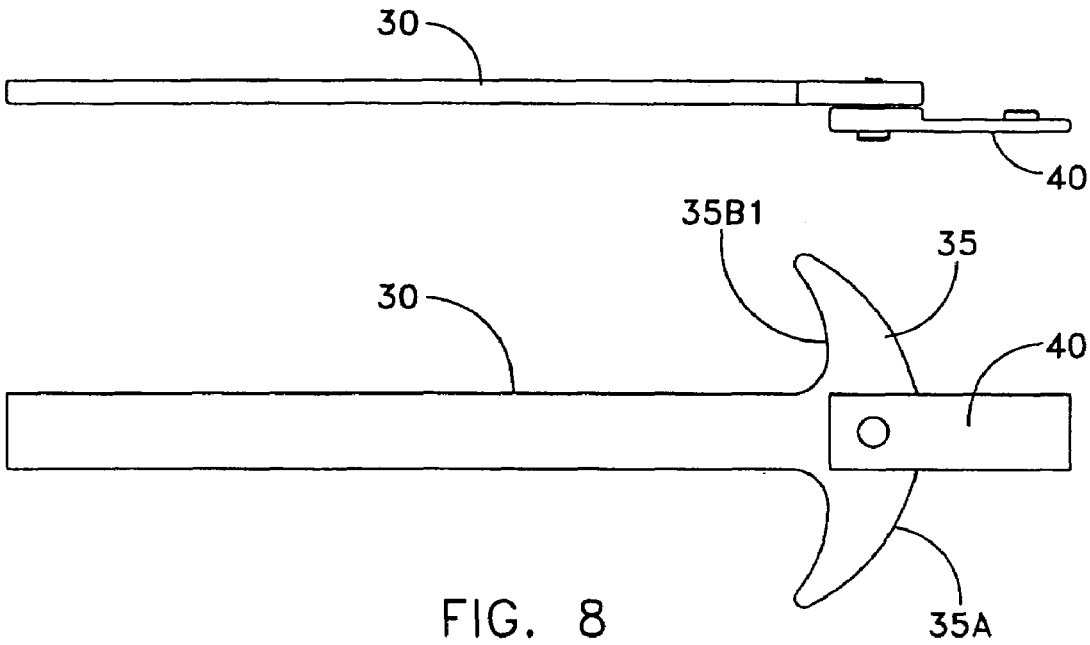
FIG. 8 illustrates an alternative embodiment of subject invention.
Figure 9:
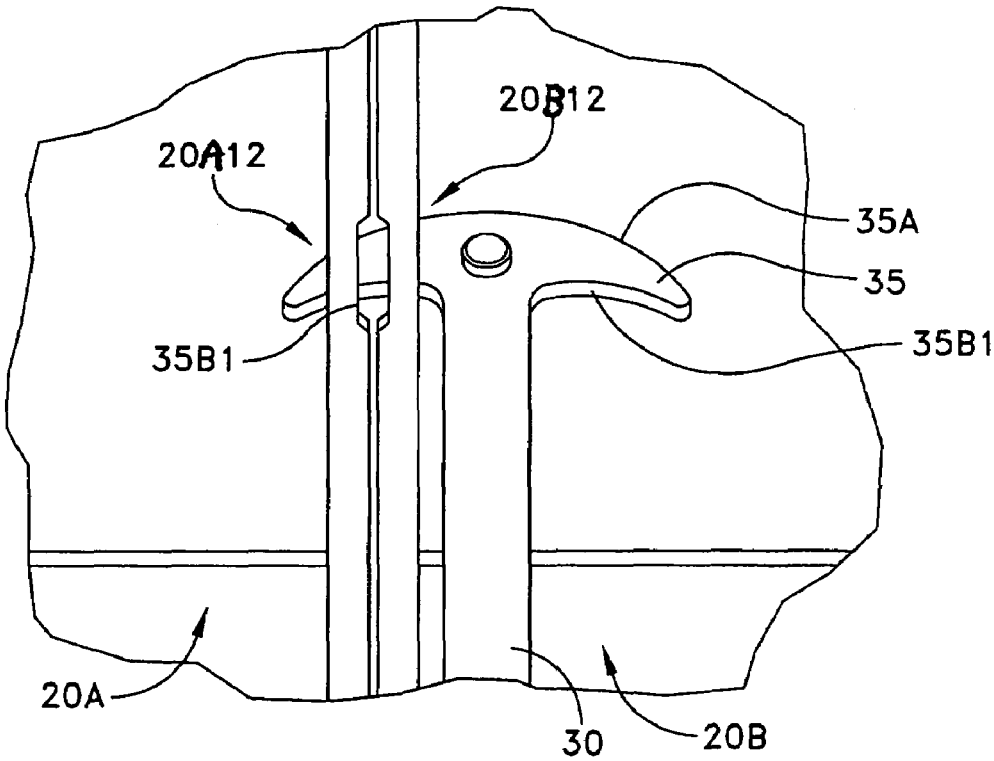
FIG. 9 illustrates the invention of FIG. 8 being used with concrete forming.

Referring to FIGS. 8 and 9, an alternative embodiment of the prying tool 12 is disclosed. In the alternative embodiment, handle member 30 and leveraging member 35 are one piece. Leveraging member 35 is integral and extends outward from one end of handle member 30. Leveraging member 35 includes a semi-circular front portion 35A and a bi-furcated rear portion 35B1 split by handle member 30. The bi-furcated rear portions 35B1 are in the form of hooks for engaging and prying concrete forms. The prying tool 12 further includes a fulcrum assembly 40 offset from leveraging member 35, with its construction and pivotal relationship to leveraging member 35 identical to that previously disclosed for the preferred embodiment.

Figure 5:
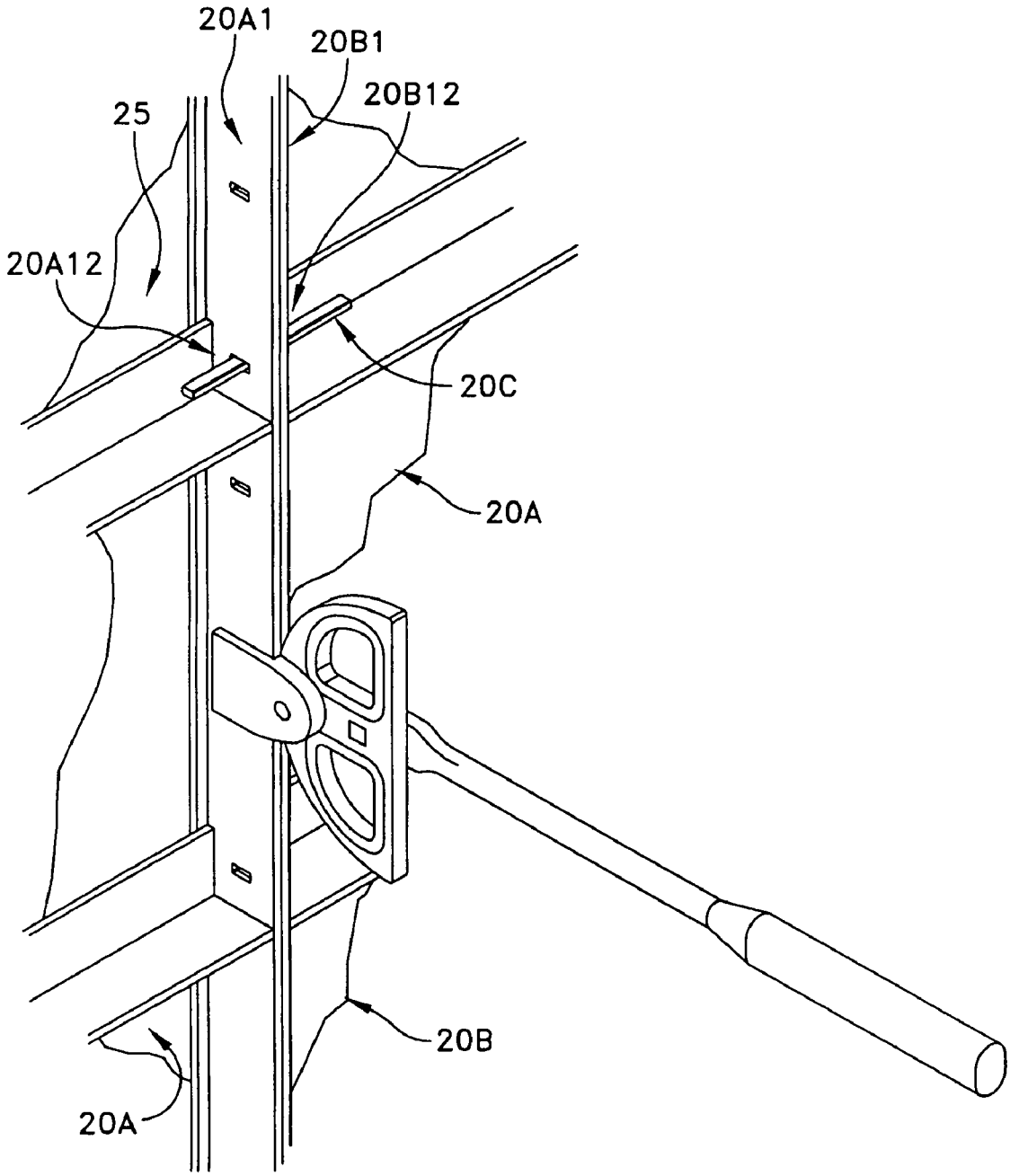
FIG. 5 illustrates the concrete framing on which subject invention operates.
Figure 6:
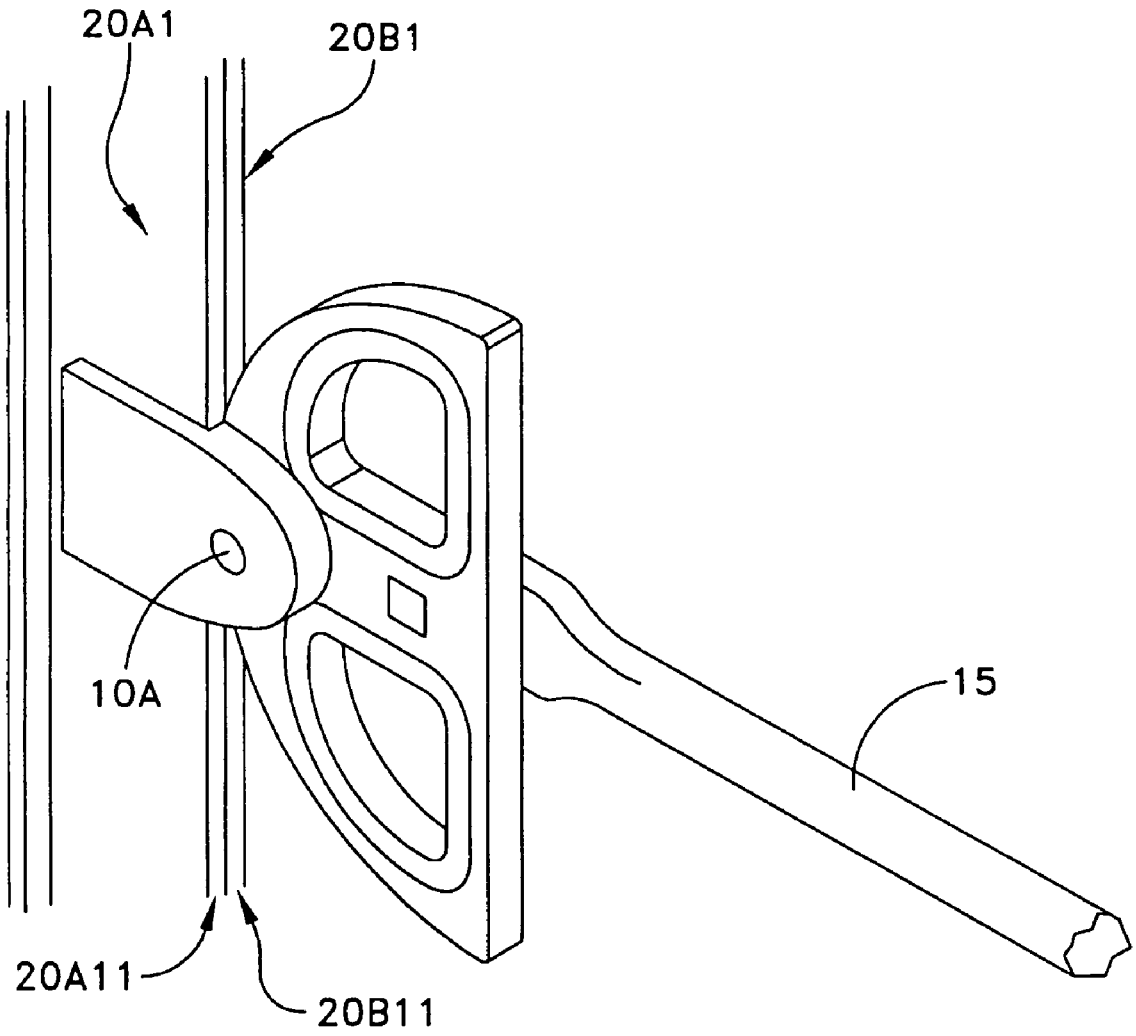
FIG. 6 illustrates subject invention in place prior to separating concrete framing from concrete.

Referring to FIG. 5, abutting concrete form frame members, of which the present invention manipulates, are illustrated. Frame members 20A and 20B are illustrative of a section of concrete framing up against cured concrete 25. In practical application, the framing sections 20A and 20B become stuck to the concrete after it dries and must be removed. Referring to FIGS. 5 and 6, frame sections 20A and 20B include abutting frame cross members with cross member side surfaces 20A1 and 20B1 and cross member front surfaces 20A11 and 20B11. Abutting frame cross members further include connecting slots 20A12 and 20B12 punched therethrough and are located at various locations along the length of cross member side surfaces 20A1 and 20B1. Referring to FIG. 5, during the installation of concrete forms 20A and 20B slots 20A12 and 20B12 would include a tie strap 20C inserted through the slots to secure the abutting cross members. After the concrete has cured and forms 20A and 20B must be separated from the concrete 25 the tie straps 20C are removed and applicants invention is employed to remove the forms from the cured concrete.

For illustrative purposes, connecting slots 20A12 and 20B12 are used to describe the operation of subject invention, however it is understood that any connecting slots along any cross members of the concrete framing may be utilized. In fact, the process of separating framing from cured concrete involves the use of subject invention at multiple connecting slots along various frame cross members to separate the framing from the concrete.

Figure 4:
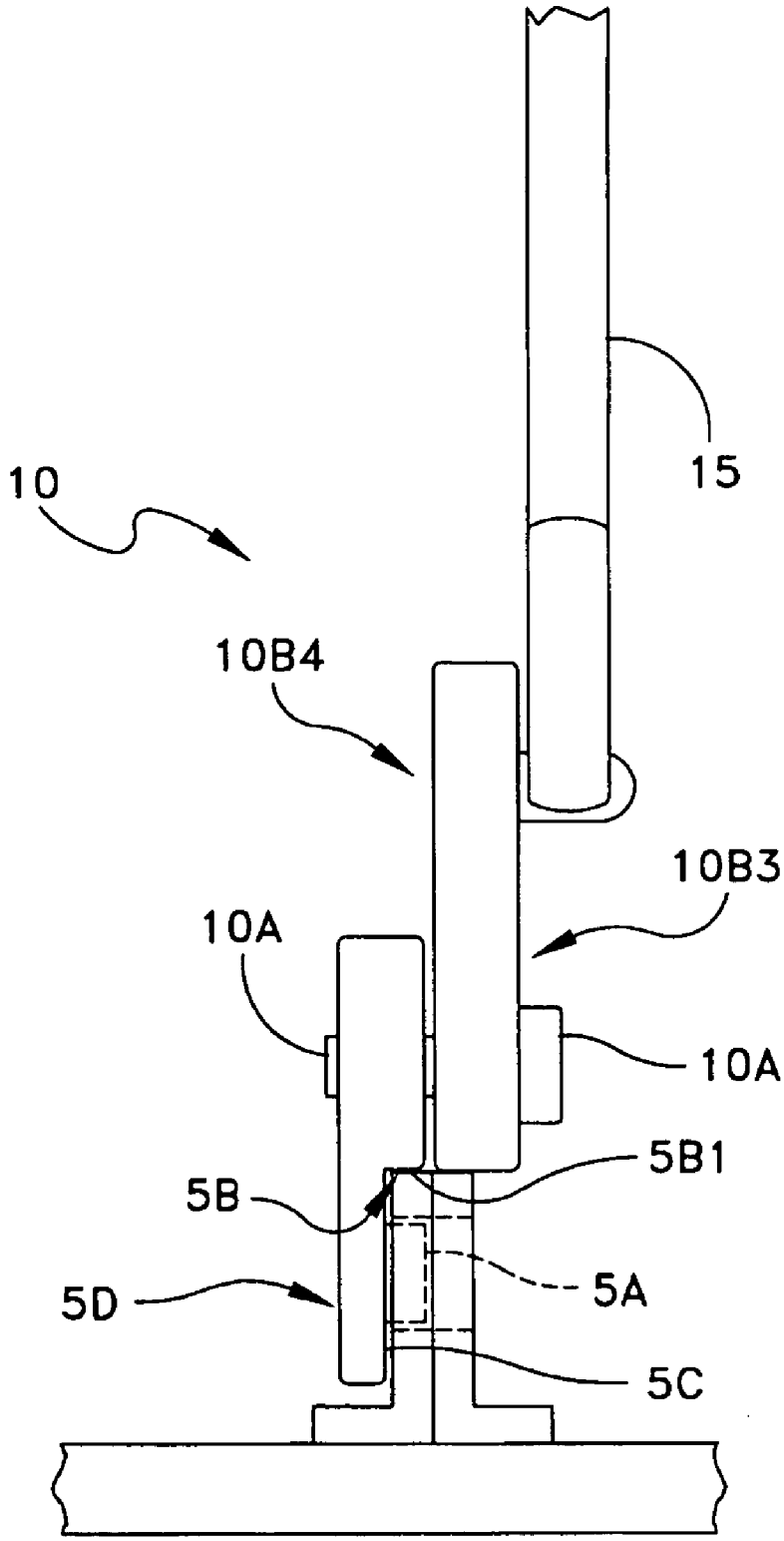
FIG. 4 illustrates an end view of the invention of FIG. 1.
Figure 7:
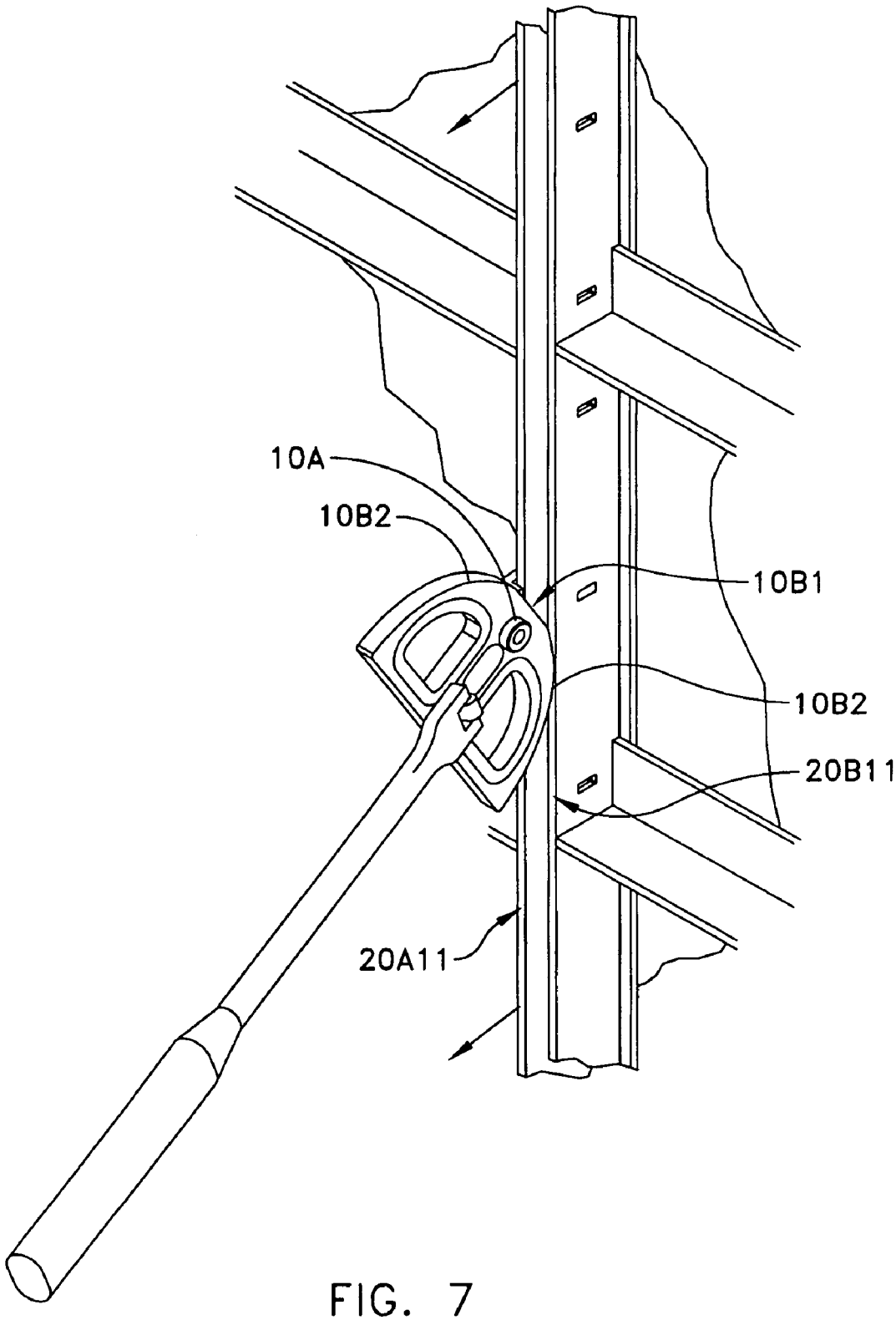
FIG. 7 illustrates the invention of FIG. 1 separating concrete framing from concrete.

Referring to FIGS. 1, 4 and 6, applicant's invention operates to separate concrete framing as follows. Protuberance 5A is inserted into connecting slot 20A12 and extends into cross member side surface 20A1 a distance not to exceed the width of front surface 20A11. In this manner cross member 20A1 can be moved independently of cross member 20B1. First side surface 5C of fulcrum assembly 5 rests against cross member side surface 20A1 with fulcrum extension mating surface 5B1 resting up against cross member front surface 20A11. Fulcrum extension mating surface 5B1 extends up to the width of front surface 20A11 and effectively offsets leveraging member 10 such that flat engagement surface 10B1 rests up against cross member front surface 20B11. Referring to FIGS. 6 and 7, as handle 15 is manipulated downward from a horizontal position, semi-circular surface 10B2 engages along its periphery and forces inward cross member front surface 20B11. This operation causes a leveraging action by exerting an outward force at fulcrum point pivoting engagement means 10A forcing engaged concrete form cross member 20A11 front surface outward away from the concrete wall 25 thereby separating the form from the wall.

The alternative embodiment of prying tool 12 operates to separate forms as previously described. However, due to the alternative construction of leveraging member 35 prying tool 12 is further utilized as a tool to pull forms during the separation process. Referring to FIG. 9, bi-furcated rear portions 35B1 may be inserted into connecting slots 20A12 and 20B12 for pulling framing sections 20A and 20B away from concrete wall 25.

We claim:

1. A prying tool for dislodging abutting first and second concrete forms from poured concrete walls, each abutting first and second concrete form having a side surface and a front surface, each concrete form side surface including a connecting slot, comprising:

a fulcrum assembly, said fulcrum assembly having a first side surface and a second side surface, said first side surface including at one end a protuberance extending outward therefrom, said protuberance for slideably engaging a connecting slot of said first concrete form side surface; a leveraging member, said leveraging member having a first and second side surface, said leveraging member pivotally connected at one end by an attachment means to the opposite end of said fulcrum assembly first side surface, said leveraging member rotating freely about said pivotal connection in an upward and downward direction, said leveraging member including a handle member extending outward from the opposite end of said leveraging member, said attachment means juxtapositioning said fulcrum assembly and said leveraging member, said leveraging member having an engagement surface extending about said leveraging member periphery, said engagement surface positioned in a plane normal to the plane of said outwardly extending protuberance of said fulcrum assembly first side surface, said engagement surface in contact with an abutting second concrete form front surface, said leveraging member engagement surface rotated freely about said pivotal connection of said attachment means by said handle, said abutting second concrete form front surface forced inward causing a leveraging action forcing said engaged first concrete form outward away from said poured concrete wall thereby separating the engaged first concrete form from the wall.

2. A pry tool according to claim 1 wherein said opposite end of said fulcrum assembly first side surface includes an extension having a side surface and a front surface, wherein said leveraging member pivotally connects at said one end by an attachment means to said extension side surface.

3. A pry tool according to claim 2, wherein said leveraging member is parallel to said fulcrum assembly extension side surface, said extension side surface slideably engages a portion of said leveraging member second side surface.

4. A pry tool according to claim 1 wherein said leveraging member is parallel to said fulcrum assembly first side surface and a portion of said first side surface of said fulcrum assembly slideably engages a portion of said leveraging member second side surface.

5. A pry tool according to claim 1, wherein said engagement surface is positioned between said protuberance and said attachment means.

6. A pry tool according to claim 1, wherein said handle member further comprises a socket connection, said socket connection for positioning said handle at different angles.

7. A pry tool according to claim 1, wherein said attachment means is a solid bar extending through said fulcrum assembly and said leveraging member.

8. A pry tool according to claim 1, wherein said leveraging member engagement surface comprises a flat portion and a semi-circular portion, said flat portion opposite said protuberance, said semi-circular portion extending away from opposite ends of said flat portion.

9. A pry tool according to claim 1, wherein said protuberance is rectangular.

10. A pry tool according to claim 1, wherein said handle and said leveraging member are one piece.

11. A pry tool according to claim 1, wherein said leveraging member engagement surface is semi-circular.

12. A pry tool according to claim 11, wherein said split bifurcated rear portion is hook shaped.

13. A pry tool according to claim 1, wherein said leveraging member includes a bifurcated rear portion, said bifurcated rear portion split by said handle member.

* * * * *